US010231890B2

(12) United States Patent
Merioles

(10) Patent No.: US 10,231,890 B2
(45) Date of Patent: Mar. 19, 2019

(54) APPARATUS FOR REDUCING THE RISK OF DEVELOPING DECUBITUS ULCERS AND ADJUNCT TO TREATMENT THEREOF ON IMMOBILE PATIENTS

(71) Applicant: KINETIC MEDICAL AID INNOVATIONS, INC., Metro Manila (PH)

(72) Inventor: Sonny Wilson R. Merioles, Albay (PH)

(73) Assignee: KINETIC MEDICAL AID INNOVATIONS, INC., Metro Manila (PH)

( * ) Notice: Subject to any disclaimer, the term of this patent is extended or adjusted under 35 U.S.C. 154(b) by 233 days.

(21) Appl. No.: 15/309,648

(22) PCT Filed: Jun. 5, 2015

(86) PCT No.: PCT/PH2015/000008
§ 371 (c)(1),
(2) Date: Nov. 8, 2016

(87) PCT Pub. No.: WO2015/187041
PCT Pub. Date: Dec. 10, 2015

(65) Prior Publication Data

US 2017/0246064 A1 Aug. 31, 2017

(30) Foreign Application Priority Data

Jun. 6, 2014 (PH) ..... 1-2014-00155

(51) Int. Cl.
*A61G 7/057* (2006.01)
*A47C 21/00* (2006.01)
(Continued)

(52) U.S. Cl.
CPC ..... *A61G 7/0573* (2013.01); *A47C 21/006* (2013.01); *A61G 7/002* (2013.01);
(Continued)

(58) Field of Classification Search
CPC ..... A61G 7/018; A61G 7/002; A61G 7/057; A61G 7/0507; A61G 7/0573; A47C 21/006; A61H 15/00; A61H 15/0078
See application file for complete search history.

(56) References Cited

U.S. PATENT DOCUMENTS 1,276,526 A * 8/1918 Hardy ..... A61H 1/008 601/103
2,052,656 A * 9/1936 Prien ..... A61H 15/00 601/115
(Continued)

FOREIGN PATENT DOCUMENTS

DE 102005015305 A1 10/2006
GB 2329250 A 3/1999
(Continued)

OTHER PUBLICATIONS

International Search Report and Written Opinion for corresponding PCT application No. PCT/PH15/00008/, dated Jan. 24, 2017.

*Primary Examiner* — Eric J Kurilla
*Assistant Examiner* — David R Hare
(74) *Attorney, Agent, or Firm* — Notaro, Michalos & Zaccaria P.C.

(57) ABSTRACT

The present invention relates to an apparatus for reducing the risk of developing decubitus ulcers on bedfast or immobile patients and adjunct to the treatment thereof. Said apparatus comprising a bed frame, a plurality of spaced apart pusher assemblies transversely disposed on said bed frame, each said pusher assemblies being defined by a hollow shaft being rotatably secured to said bed frame, a worm and hollow gear combination provided on said hollow shaft, a plurality of slits spacedly provided on said hollow shaft, an internal screw shaft rotatably disposed within said hollow shaft with one end extending outwardly through said hollow gear, said internal screw shaft being provided with second-
(Continued)

ary worm and gear combination, a plurality of spaced apart internally threaded bushings screwably held along said internal screw shaft, a protruding member projecting outwardly from each internally threaded bushing and through corresponding slit of said hollow shaft, and a pusher member securedly held on each of said protruding member.

5 Claims, 6 Drawing Sheets

(51) Int. Cl.
*A61H 15/00* (2006.01)
*A61G 7/05* (2006.01)
*A61G 7/002* (2006.01)

(52) U.S. Cl.
CPC ..... *A61G 7/057* (2013.01); *A61G 7/0507* (2013.01); *A61H 15/00* (2013.01)

(56) References Cited

U.S. PATENT DOCUMENTS 2,773,498 A * 12/1956 Himmelman ..... A61H 15/0078 5/934
2,840,072 A * 6/1958 Stearns ..... A61H 15/0078 601/115
3,298,363 A * 1/1967 Parkin ..... A61H 1/00 5/236.1
3,970,077 A * 7/1976 Dahl ..... A61G 7/0573 601/99
4,179,692 A 12/1979 Vance
4,295,133 A 10/1981 Vance
4,412,534 A * 11/1983 Hamabe ..... A61H 1/00 601/102
4,425,676 A 1/1984 Crane
4,484,043 A 11/1984 Musick et al.
4,565,910 A 1/1986 Musick et al.
4,700,180 A 10/1987 Vance
4,751,918 A * 6/1988 Bernard ..... A61G 7/0573 5/933
4,799,276 A * 1/1989 Kadish ..... A61G 7/0573 137/901
4,958,627 A * 9/1990 Park ..... A61H 23/0263 601/108
4,999,861 A * 3/1991 Huang ..... A47C 21/006 5/600
5,072,468 A 12/1991 Hagopian
5,092,315 A * 3/1992 Bennett ..... A61H 1/00 601/101
5,109,558 A * 5/1992 Di Blasi ..... A61G 7/0573 5/236.1
5,233,712 A * 8/1993 Jurus ..... A61G 7/0573 5/611
5,233,973 A * 8/1993 Gill ..... A47C 21/006 5/612
5,554,835 A 9/1996 Newham
5,600,108 A 2/1997 Newham
5,623,760 A 4/1997 Newham
5,626,555 A * 5/1997 Di Blasi ..... A47C 21/006 5/612
5,633,627 A 5/1997 Newham
5,640,145 A 6/1997 Newham
5,654,694 A 8/1997 Newham
5,769,799 A * 6/1998 Daughtry ..... A61H 15/0078 601/115
5,926,884 A 7/1999 Biggie et al.
6,307,476 B1 10/2001 Smith et al.
6,557,937 B1 * 5/2003 Shah ..... A47C 7/028 297/284.3
6,799,342 B1 * 10/2004 Jarmon ..... A61G 7/0573 5/191
7,552,491 B2 * 6/2009 Voelker ..... A61G 7/0573 5/241
7,905,846 B2 * 3/2011 Ganti ..... A61H 23/006 601/101
8,011,044 B1 * 9/2011 Jones ..... A61G 5/10 297/284.3
8,719,980 B2 * 5/2014 Chen ..... A61H 7/001 297/311
2004/0215113 A1 * 10/2004 Saringer ..... A47C 3/02 601/90

FOREIGN PATENT DOCUMENTS

WO 2008105746 A1 9/2008
WO WO-2008105746 A1 * 9/2008 ..... A61G 7/0573
WO 2015187041 A2 12/2015

* cited by examiner

FIG. 4
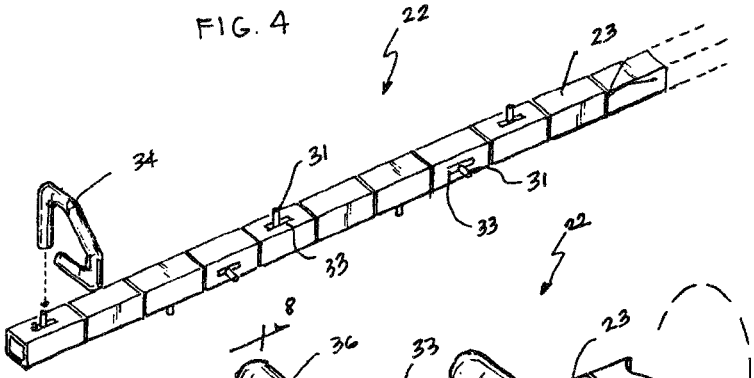
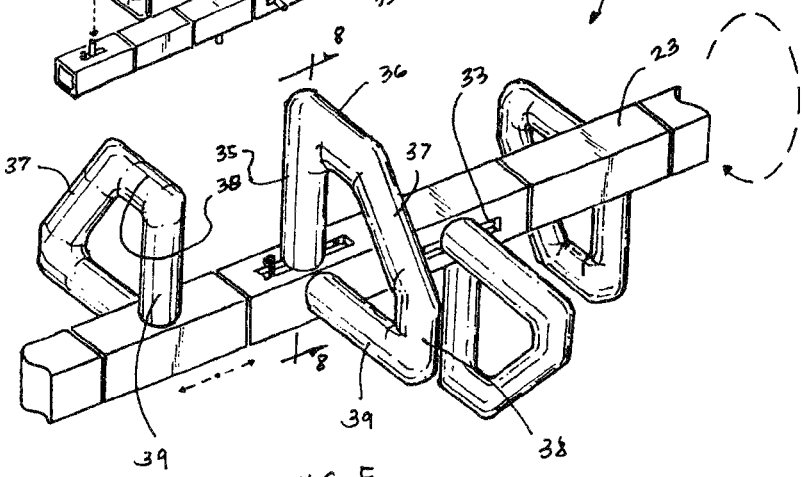
FIG. 5

APPARATUS FOR REDUCING THE RISK OF DEVELOPING DECUBITUS ULCERS AND ADJUNCT TO TREATMENT THEREOF ON IMMOBILE PATIENTS

TECHNICAL FIELD OF THE INVENTION

This invention relates generally to apparatus for reducing the risk of bedfast patients developing decubitus ulcers or bedsores and adjunct to treatment thereof.

BACKGROUND OF THE INVENTION

It is well known that patients who are confined to a bed or chair for extended periods of time are at risk of developing decubitus ulcers, i.e., pressure sores, or bed sores as they are more commonly known. These ulcers are often seen to develop within soft tissue that is compressed between a bed or chair surface and a patient's weight-bearing bony prominences, the compressed tissue being at least partially deprived of oxygenated blood flow. A continued lack of blood flow, and resultant lack of oxygen, can result in cell death which may be evidenced in the form of pressure sores. Pressure sores do not develop immediately, but rather form over time, with the development speed depending on a number of factors including the firmness and friction of the supporting surface against the patient's skin, the patient/ambient temperature, the amount of moisture in contact with the skin, and the health and susceptibility of the skin due to age or illness.

One venerable and generally accepted means of reducing the risk of decubitus ulcer development in bedfast patients is to turn them regularly, usually at approximately two hour intervals. For example, a patient in a back rest position might be periodically rolled to one side or the other, such motion helping to maintain blood to flow to soft tissue that is under compression. Similar strategies are employed for patients that are confined to a chair for long periods of time. Obviously, an assisted-movement strategy relies to a large extent on the vigilance of the attending staff to insure that the patient is properly relocated. Further, it is far too easy for the busy care giver to let the time for turning the patient slip by in the press of other daily emergencies. To the extent that the caregiver is too busy or forgets to perform this service, this method can fail to achieve its purpose. Further, this sort of strategy can be counterproductive for use with the patient that has some capacity for self movement.

More particularly, the process of moving a patient to another position is admittedly disruptive to the patient and this is especially true at night, since the patient—if he or she were sleeping—will be awakened for the purpose of relocation. The typical two-hour movement interval must be observed around the clock if the method is to be effective, so it is necessary to rouse the patient—who might be sleeping soundly at the time—to make the required adjustment in position. Further, this adjustment might not have even been necessary if the patient had recently moved of his or her own volition. Thus, in many situations it would be advantageous for the caregiver to know if and when the patient last moved his or herself. Then, if the last movement were within a prescribed period of time, it might be possible to spare the patient an unnecessary interruption in his or her healing sleep. The caregiver would then relocate the sleeping patient, only if that relocation were actually required. Further, knowing which patients do not need to be moved could result in a substantial savings in labor costs, as the time that would otherwise be devoted to moving the patient that did not actually need to be moved could be productively applied elsewhere. That being said, as useful as this sort of information might be to the health care provider, however, the present state-of-the-art in patient management does not provide this sort information.

Generally speaking, there are two broad inventive approaches to dealing with decubitus ulcers: mechanical and medicinal. The mechanical approach is aimed at preventing the occurrence of bed sores through the use of a specialized mattress, pad, or other arrangement, which is designed to lessen the weight-pressure that is brought to bear on the patient's bony prominences. These devices might be either static (e.g., foam, air, or water mattresses) or dynamic (e.g., compartmentally inflatable mattresses that dynamically shift the locus of support pressure under the patient in response to the patient's movements). Examples of inventions in the prior art that are generally concerned with this subject matter are U.S. Pat. Nos. 4,425,676, 5,926,884, and 5,072,468.

On the other hand, the medical—or second inventive—approach is concerned with the development of medicinal compounds and methods of treating the ulcer after it occurs. This approach is obviously useful, but reactive, rather than proactive, as it attempts to minimize the damage occasioned by the ulcer after it has formed.

General information relating to mats for use in patient monitoring may be found in patent application Ser. No. 09/285,956 filed Apr. 2, 1999. Additionally, U.S. Pat. Nos. 4,179,692, 4,295,133, 4,700,180, 5,600,108, 5,633,627, 5,640,145, and 5,654,694 (concerning electronic monitors generally) contain further information generally pertinent to this same subject matter, as do U.S. Pat. Nos. 4,484,043, 4,565,910, 5,554,835, and 5,623,760 (switch patents).

Heretofore in the patient monitoring arts there has been no apparatus or method aimed specifically at reducing the risk of bed sores in a semi-invalid patient, i.e., the patient who at least occasionally moves without assistance. With a semi-invalid patient, assisted repositioning—whether manual or mechanical—should only take place if the patient has not moved for some particular period of time. This, of course, suggests the need for a method and apparatus for monitoring the patient so that the time when he or she last moved can be determined. Further, the amount or magnitude of the patient's movement should also be monitored so that a repositioning will still take place as scheduled if the patient has moved during the previous time period, but the amount of movement has not exceeded some particular threshold level (i.e., whether or not a significant relocation or movement has occurred). Finally, there is a need for an apparatus that can monitor and report the overall amount of patient self-induced and/or caregiver assisted movement, so as to give the caregiver (or that person's supervisor) some estimate of the amount of movement by the patient in the bed.

GB-A-2,329,250 shows an invention that helps monitors the movement of a patient. This patent provides a mechanism for the non-intrusive electronic determination of the orientation and presence of a person or infant in a bed, cot or chair using primary and secondary coils. A number of air-cored transformers are formed by a primary coil formed around a mattress or the seat or back of a chair, and secondary coils are then provided integrated into an item of clothing. The secondary coils have different resonant frequencies and are located to define different pressure points on the body. Using such an apparatus, if there has been no movement within a predetermined time, an alarm may be raised.

Various systems and devices including those discussed above exist for shifting the pressure exerted on an immobilized individual. These systems include beds having movable sections; however, such beds are expensive and impractical for large institutions treating many individuals. For surgical situations, where a sterile environment is essential, devices must be properly cleaned after each use. Such maintenance adds significant complexity and cost.

Accordingly, it would be desirable to provide an economical device, which is easy to use and requires little or no maintenance, for shifting the position of an immobilized individual to prevent and/or inhibit decubitus ulcers. Heretofore, as is well known in the patient monitor arts, there has been a need for an invention to address and solve the above-described problems. Accordingly, it should now be recognized, as was recognized by the present inventors, that there exists, and has existed for some time, a very real need for a system for monitoring patients that would address and solve the above-described problems.

Before proceeding to a description of the present invention, however, it should be noted and remembered that the description of the invention which follows, together with the accompanying drawings, should not be construed as limiting the invention to the examples (or preferred embodiments) shown and described. This is so because those skilled in the art to which the invention pertains will be able to devise other forms of this invention within the ambit of the appended claims.

These and other object and advantages of said invention will come to light upon a reading of the following description when taken in conjunction with the appended drawings.

BRIEF DESCRIPTION OF THE SEVERAL VIEWS OF THE DRAWINGS

FIG. 4 is an isolated perspective view of the rectangular shaft holding the plurality of pusher members;

FIG. 5 is an enlarged perspective view taken along FIG. 4;

DETAILED DESCRIPTION

Figure 1:
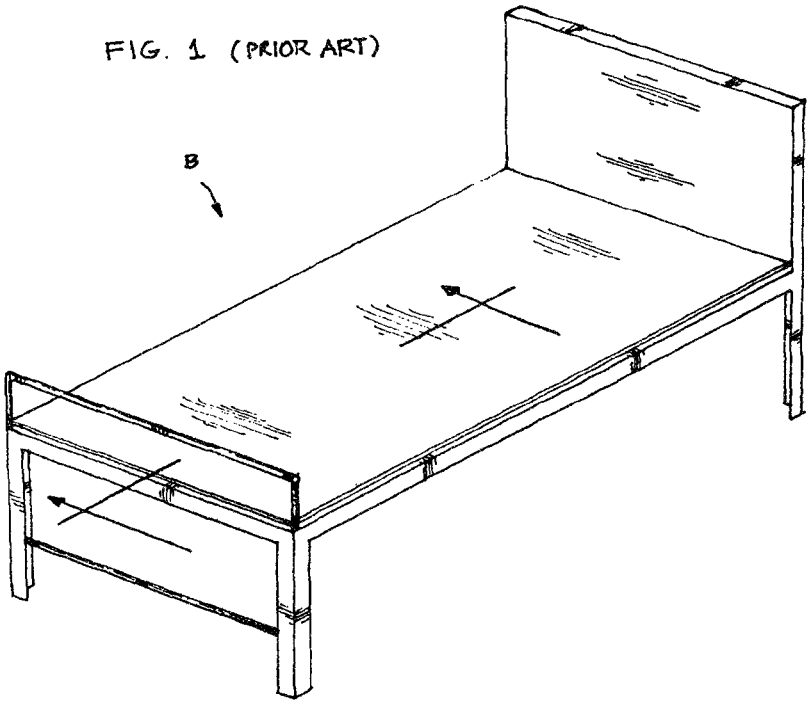
FIG. 1 (PRIOR ART)
FIG. 1 is a perspective view of a bed of the prior art.

Referring now to the several views of the drawing wherein like reference numerals designate same parts throughout, shown is the invention for an apparatus for reducing the risk developing decubitus ulcers or bedsores on bedfast or immobile patients generally designated as reference numeral 10.

Figure 2:
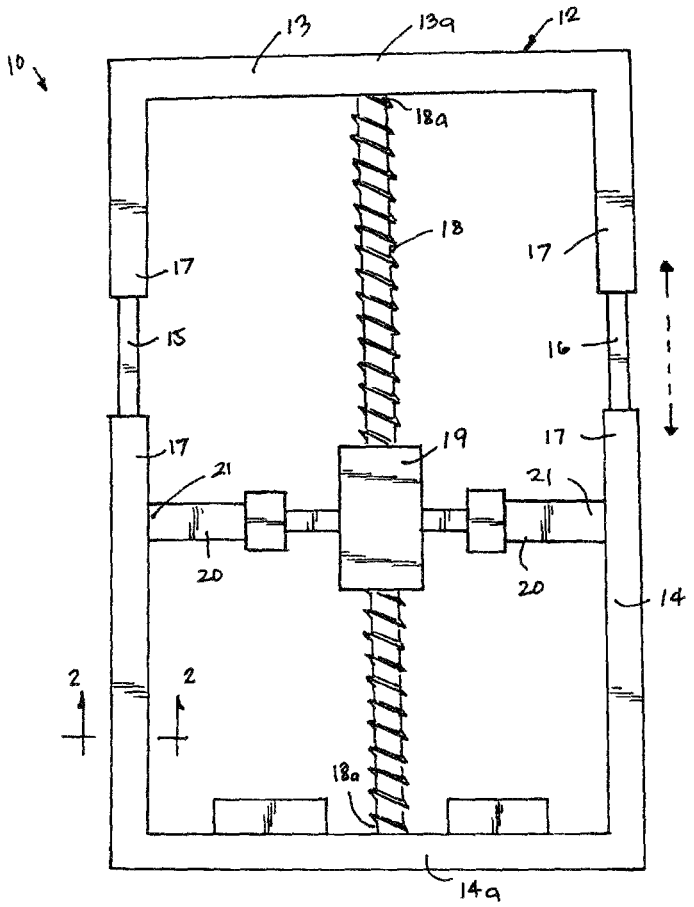
FIG. 2 shows the top view of the bed frame overlay being used to reduce the risk of developing decubitus ulcers or bedsores on immobile patients and adjunct to treatment thereof according to the present invention.

Said apparatus 10 is adapted to be mounted on top of an ordinary bed "B" shown in FIG. 1. Said apparatus 10 shown in FIG. 2, comprises an adjustable bed frame 12 having a pair of opposing U-shaped complementary members 13 and 14, a pair of opposing elongated rails 15 and 16 supporting the free arms 17 of said opposing U-shaped complementary members 13 and 14, at least one adjustable threaded shaft 18 rotatably mounted longitudinally along middle portion of said pair of U-shaped complementary members 13 and 14, said threaded shaft 18 having its opposing ends 18*a* rotatably secured at the web portion 13*a* and 14*a* of the U-shaped complementary members 13 and 14, an internally threaded carrier 19 screwably associated with said threaded shaft 18, a pair of opposing beams 20 outwardly projecting from said internally threaded carrier 19 with the distal ends 21 respectively secured on the opposing arms of one of said U-shaped complementary members 13 and 14, and a plurality of spaced apart pusher assemblies being represented by reference numeral 22 as shown in FIG. 4 rotatably disposed transversely within said bed frame 12. Said pusher assemblies 22 although not shown in FIG. 2 are understood to be spacedly transversely on said bed frame 12.

Figure 6:
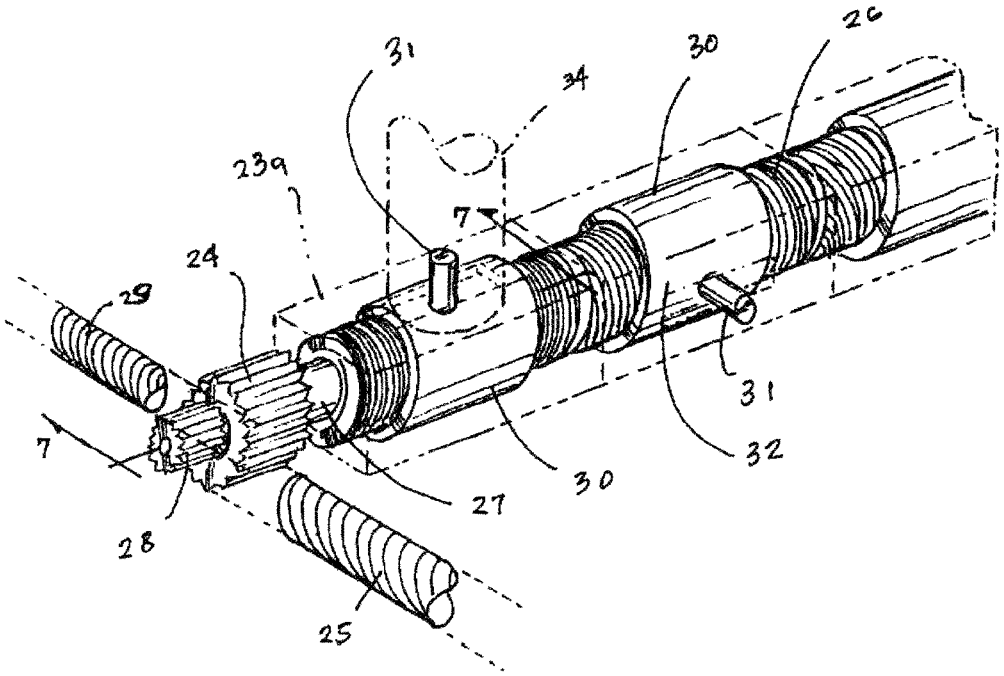
FIG. 6 is an isolated perspective view of the rectangular shaft showing the internal parts thereof.
Figure 7:
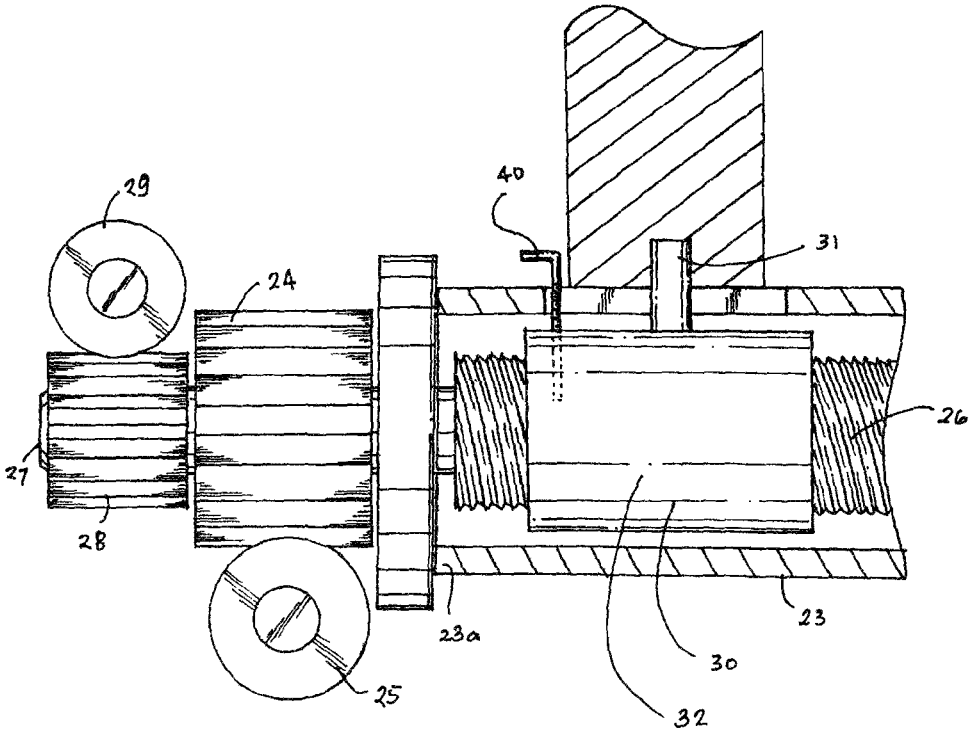
FIG. 7 is a sectional view taken from line 7-7 of FIG. 6.
Figure 8:
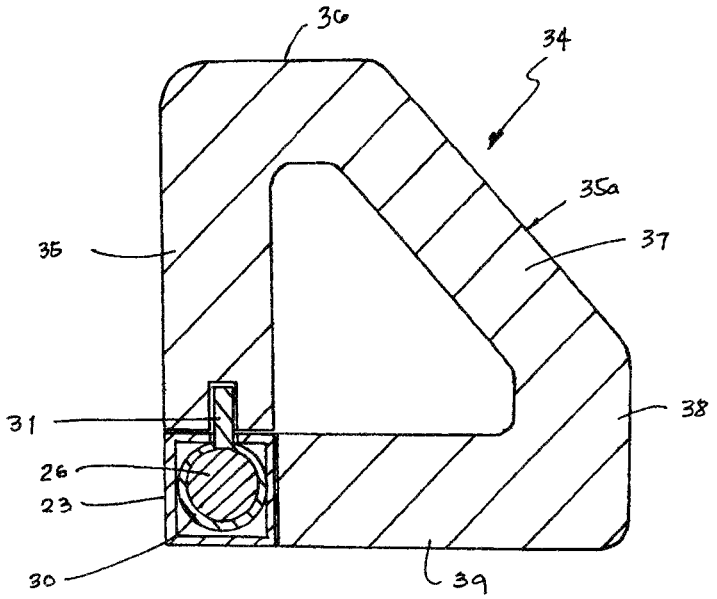
FIG. 8 is a sectional view of the pusher member taken along line 8-8 of FIG. 4.

Each of said pusher assemblies 22 is defined by a rectangular hollow shaft 23 having their opposing ends 23*a* rotatably secured along the opposing free arms 17 of said complementary members 13 and 14. As best seen in FIG. 6, said rectangular hollow shaft 23 is provided with a hollow gear 24 which is engage with a driving worm 25 that is connected to a driving motor (not shown). Rotatably disposed within said rectangular hollow shaft 23 is an internal screw shaft 26 having one of its end rotatably secured thereof with one end of said rectangular hollow shaft 23. The other opposing end 27 extends outwardly through said hollow gear 24 of said hollow rectangular shaft 23. Said opposing end 27 is keyed with a secondary gear 28 which is engaged with a complementary secondary worm 29 being driven by another motor (not shown). Screwably connected along said internal screw shaft 26 is a plurality of spaced apart internally threaded bushings 30. Each of said internally threaded bushings 30 is provided with a protruding member 31 projecting outwardly from the outer surface 32 thereof and extending through a slit 33 provided therefor on one of the sides of said hollow rectangular shaft 23, thus, said hollow rectangular shaft 23 would have a plurality of slits 33 provided along its sides with respective protruding members 31 thereof as shown in FIGS. 5 and 6. It should be noticed that said slits 33 with corresponding protruding members 31 are arranged in said hollow rectangular shaft 23 in a series formation. Meaning that, if the first slit 33 is disposed on top portion 23*a* of said rectangular shaft 23, the second slit 33*a* is disposed at the left side wall 23*b*. The third slit 33*b* is then located at the bottom side portion 23*c*, and the fourth slit 33*d* is positioned at the right side wall 23*d*. The four positions of the slits 33*a*, 33*b*, 33*c* and 33*d* with corresponding protruding members 31 completes the cycle of the series formation thereof. This means that after the fourth slit 33*d*, another cycle thereof starts and so on. The pusher assembly 22 is further provided with a plurality of pusher members 34, each being fixed attached to corresponding protruding member 31. Thus, the positioning of the slit together with the corresponding pusher members covers the four quadrant of the cycle of 360 degrees.

Each of said pusher members 34 is defined by a substantially number 4-shaped body 35*a* having an upstanding support post 35 with an abbreviated first pusher portion 36 laterally projecting from the upper end of said upstanding support post 35, an intermediate portion 37 inclinedly and downwardly projecting from the end of said abbreviated first pusher portion 36, a abbreviated second pusher portion 38 extending vertically and downwardly from the lower end of said intermediate portion 37, and terminating to a horizontal portion 39 provided thereof.

Figure 3:
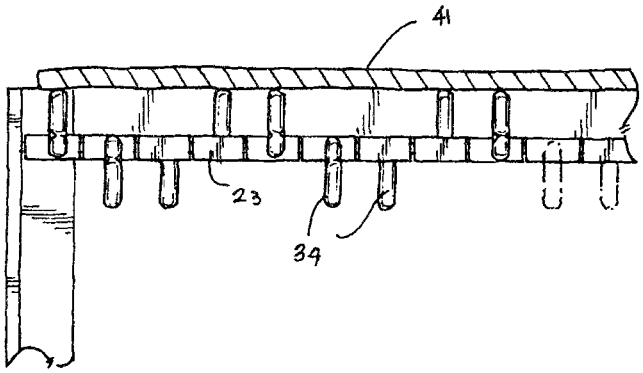
FIG. 3 is a fragmentary sectional view take from line 2-2 of FIG. 2.

In using said apparatus 10, said bed frame 12 is adjusted to a desired length, either increasing or decreasing length depending on the height of the patient. Said length is adjusted by rotating the adjustable threaded shaft 18 in a clockwise manner for increasing the length or counter-clockwise for decreasing the length of said bed frame 12. The rotating of said adjustable threaded shaft 18 is done with the use of lever or by means of a motor (not shown) connected thereof. Before laying down the patient on said apparatus 10, the spacing of the pusher members 34 is adjusted according to the instructions given by the attending doctors of the patient. Said spacing of the pusher members 34 is adjusted by rotating slowly the internal screw shaft 26 by means of through the secondary worm 29 and secondary gear 28 combination. With this, the internally threaded bushings 30 moves forwardly or backwardly until a the desired position and spacing is attained. Said internally threaded bushings 30 are then fixed in its position by means of a set screw 40 traversing said bushings 30 and setting it with the internal screw shaft 26. After locking said internally threaded bushings 30 with the internal screw shaft 26, the secondary worm 29 is then disengaged with the secondary gear 28 to allow said internal screw shaft 26 to rotate together with the hollow rectangular shaft 23. At this point, a thin mattress 41 is laid on top of the pusher members 34 as shown in FIG. 3 on to where the patient is laid.

Initially, only the first pusher members 34 of each cycle along one pusher assembly 22 through the second pusher portions 38 are engaged with the back of the patient. With predetermined intervals, preferably of 1 or 2 hours, depending on the instruction of the attending doctor of the patient, the driving motor is activated to rotate the driving worm 25 and gear combination and said hollow rectangular shaft 23 in a quarter turn, releasing the areas at the back of patient that are engaged with the second pusher portion 38 of said first pusher members 34. Upon completion of the quarter turn, the first pusher portion 36 of said first pusher member 34 now engages with the back of the patient at an area different from the one that have engaged with the second pusher portion 38. At this point, the second pusher portions of the adjacent second pusher members are now in contact with an area at the back of the patient. After 1 or 2 hours, the driving motor is again activated to rotate the hollow rectangular shafts to release the area at the back of the patient with the respective pusher portion of the adjacent pusher members and so on. On direction of the attending doctor, the spacing of the pusher members 34 may again be adjusted so that engagement of the pusher members with the back of the patient may be transferred from one area to another. This approach actually prevents the development of decubitus ulcers or bedsores at the back of the patient or may help in the treatment of such if the patient has already said decubitus ulcers or bedsores.

The invention claimed is:

1. Apparatus for reducing the risk of bedfast patients developing decubitus ulcers comprising: a bed frame, a plurality of spaced apart pusher assemblies transversely disposed on said bed frame, each said pusher assemblies being defined by a hollow shaft being rotatably secured to said bed frame, a worm and hollow gear combination provided on said hollow shaft, a plurality of slits spacedly provided on said hollow shaft, an internal screw shaft rotatably disposed within said hollow shaft with one end extending outwardly through said hollow gear, said internal screw shaft being provided with secondary worm and gear combination, a plurality of spaced apart internally threaded bushings screwably held along said internal screw shaft, a protruding member projecting outwardly from each internally threaded bushing and through corresponding slit of said hollow shaft, and a pusher member securedly held on each of said protruding member.

2. Apparatus for reducing the risk of bedfast patients developing decubitus ulcers according to claim 1 wherein said pusher member is defined by a substantially number 4-shaped body having an upstanding support post with an abbreviated first pusher portion laterally projecting from an upper end of said upstanding support post, an intermediate portion inclinedly and downwardly projecting from an end of said abbreviated first pusher portion, an abbreviated second pusher portion extending vertically and downwardly from a lower end of said intermediate portion, and terminating to a horizontal portion provided thereof.

3. Apparatus for reducing the risk of bedfast patients developing decubitus ulcers according to claim 1 wherein said slits on said hollow shaft together with said pusher members are arranged in a series formation along said hollow shaft and covering every quadrant of a 360 degree cycle.

4. Apparatus for reducing the risk of bedfast patients developing decubitus ulcers according to claim 1 wherein the hollow shafts together with the pusher members are activated to make a quarter turn periodically in a predetermined intervals.

5. Apparatus for reducing the risk of bedfast patients developing decubitus ulcers according to claim 1 wherein the area of contact between a back of the patient and a pusher member within a series or a cycle is not repeated.

* * * * *